United States Patent [19]

Goldstein

[11] Patent Number: 4,714,857

[45] Date of Patent: Dec. 22, 1987

[54] INFRARED REFLECTIVE LAMP WITH ENVELOPE HAVING STRAIGHT SECTIONS

[75] Inventor: Irving S. Goldstein, Teaneck, N.J.

[73] Assignee: Duro-test Corporation, North Bergen, N.J.

[21] Appl. No.: 854,324

[22] Filed: Apr. 21, 1986

[51] Int. Cl.[4] ..... H01K 1/28; H01K 1/32

[52] U.S. Cl. ..... 313/112; 313/114; 313/634

[58] Field of Search ..... 313/111, 112, 113, 114, 313/116, 634, 635, 578; 220/2.1 R, 2.2

[56] References Cited

U.S. PATENT DOCUMENTS

| | | | |
|---|---|---|---|
| 1,621,360 | 3/1927 | Falge | 313/116 |
| 1,948,516 | 2/1934 | De Vault | 313/114 X |
| 2,744,210 | 5/1956 | Ferguson | 313/111 |
| 3,259,776 | 7/1966 | Wallace | 313/111 |
| 3,369,115 | 2/1968 | Yonkers | 313/634 X |
| 4,311,940 | 1/1982 | Fitzgerald | 313/578 X |
| 4,379,249 | 4/1983 | Walsh | 313/112 |

*Primary Examiner*—Leo H. Boudreau
*Assistant Examiner*—Sandra L. O'Shea
*Attorney, Agent, or Firm*—Darby & Darby

[57] ABSTRACT

An incandescent electric lamp includes an envelope with a wall having an inner and an outer curved surfaces. An incandescent filament is located within the envelope. A device is provided to connect the incandescent filament to a source of electrical power to cause it to incandesce. The curved inner surface of the envelope is defined by a plurality of interconnecting, substantially flat chord surfaces interposed to each other at an angle.

15 Claims, 3 Drawing Figures

INFRARED REFLECTIVE LAMP WITH ENVELOPE HAVING STRAIGHT SECTIONS

BACKGROUND OF THE INVENTION

Various types of incandescent lamps have been proposed with an envelope having a coating thereon having as high a coefficient of transmissivity as possible to light energy in the visible range and as high a coefficient of reflectivity as possible to energy in the infrared range. The envelope is shaped and the filament is shaped and located so that infrared energy is reflected back to the filament to raise its operating temperature thereby requiring less power from the external electrical source to heat the filament to its point of incandescence and thereby resulting in improved efficiency of the lamp.

In general, such lamps have used a variety of coatings, such as, for example, two thin films of a dielectric material which are separated by a film of a highly electrically conductive metal (see U.S. Pat. No. 4,160,929 to Thorington, et al), two layers of a highly electrically conductive metal which is separated by a dielectric (see U.S. Pat. No. 4,409,512 to Walsh); and various types of multi-layer semiconductor coatings, etc.

The envelopes for such lamps are of glass and can have a variety of shapes, for example, spherical (see U.S. Pat. No. 4,160,929) or ellipsoidal (see U.S. Pat. No. 4,375,605). While such lamps are fully operative, it is somewhat difficult from a manufacturers point of view to readily form an envelope having the exact sphericity in the case of a spherical envelope or the proper radii in the case of an ellipsoid or other shape. If the desired shape of the envelope is not exact, or there are irregularities from the desired shape, then the infrared energy which is to be reflected by the coating back onto the filament may miss its target, thereby reducing the lamp's gain in efficiency.

Envelopes for lamps of this type are sometimes formed in two pieces each being pressed in a suitable glass manufacturing operation. However even here, in the case where the interior wall of the envelope where the infrared reflective coating is to be laid down is a continuous curved surface, it is somewhat difficult to obtain the desired accuracy in the shape or degree of smooth surface finish on the envelope interior. Any roughness, depression, projections or other blemish on the interior of the envelope may cause the infrared energy to be reflected in a manner such that it either misses or does not return to the desired part of the filament.

SUMMARY OF THE INVENTION

The present invention relates to an improved incandescent lamp and an envelope therefore of the type using an infrared (IR) reflective coating. In accordance with the invention, the envelope is made so that its inner wall is formed with a number of straight sections which are chords of an arc rather than a continuous curve as is common with most other envelopes for lamps of this type. The use of such an envelope permits easier fabrication of lamp envelopes of various overall shapes such as ellipsoid or spherical while at the same time still providing a reasonable degree of efficiency to the reflection of IR energy. In a preferred embodiment the lamp envelope is made having generally elliptical sections at its end with the straight sections as chords of arcs and a central cylindrical section to better control the IR reflectivity and thereby better control the temperature distribution along the filament length.

It is therefore an object of the present invention to provide an incandescent lamp having an envelope whose inner surface is formed with a number of straight sections which are chords of arcs and have a visible light transmissive and IR reflective coating thereon.

Another object is to provide an envelope of generally elliptical shape for an incandescent lamp, the internal surface of which is formed by a plurality of straight sections having an IR reflective coating thereon.

A further object is to provide an incandescent lamp of the IR reflective type having an envelope whose ends are generally elliptical in shape and whose center section is generally cylindrical in order to provide a better temperature distribution for the filament.

BRIEF DESCRIPTION OF THE DRAWINGS

Other objects and advantages of the present invention will become more apparent upon reference to the following specification and annexed drawings in which.

While the invention will be desribed in connection with a preferred embodiment, it will be understood that it is not intended to limit the invention to that embodiment. On the contrary, it is intended to cover all alternatives, modifications and equivalents as may be included within the spirit and the scope of the invention as defined by the attended claims.

DESCRIPTION OF THE PREFERRED EMBODIMENTS

Figure 1:
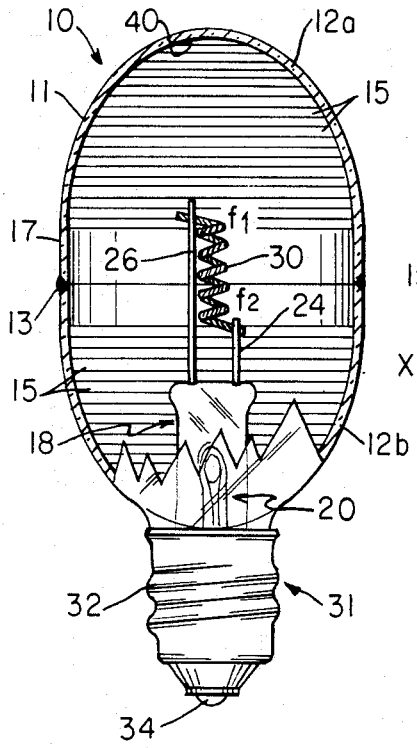
FIG. 1 is an overall view of a lamp made in accordance with the invention.

Referring to FIG. 1, the preferred embodiment of the lamp 10 includes an envelope 11 of any conventional glass material formed by upper and lower sections **12*a* and 12*b* which are joined together on a seam 13** by any suitable technique such as an adhesive, glass solder, etc.

The lamp 10 has a stem press 18 or other type electrical feedthrough with the usual tubulation 20 through which the interior of the envelope is exhausted in the conventional manner. A pair of mounting lead wires 24 and 26 which extend upwardly from the stem press 18 and also form the current lead-ins for the filament.

An elongated filament 30 is connected between the upper ends of the two mounting wires. The filament can be of any suitable material and is preferably of coiled coil or triplecoiled (a coiled-coil filament which is thereafter coiled again) construction. The exact material for and shape of the filament is not critical to the subject invention.

The lower end of one of the mounting wire 24 is connected to a conductive, threaded shell 32 of a base 31 while the other lower end of the other wire 26 is connected to the conductive button contact 34. If desired, a different type base mounting arrangement can be used such as by forming an opening in the envelope bottom half and mounting an integral base and filament unit such as shown in U.S. Pat. No. 4,256,989 to Trutner, et al.

The overall configuration of the envelope 11 is preferably ellipsoidal. That is, there is a major axis along the vertical direction of the lamp of FIG. 1 and a minor axis transverse to the major axis The overall elliptical shape has two focal points which are designated as $f_1$ and $f_2$ which are shown as lying somewhere along the length of the filament, symetrical to the filament center, for example at locations as described in U.S. Pat. No. 4,375,605 to Fontana, et al. All of the foregoing patents are owned by the assignee. The envelope is circular in cross-section in any plane transverse to the filament. The lower section 12*b* of the envelope is identical to upper section 12*a*, except for having an opening into which the stem press areas is inserted and suitably sealed off or other suitable means for electrically connecting to the filament and exhausting the lamp.

The inner wall of the envelope 11 is coated with a material 40 which is as highly transmissive as possible to visible light and as highly reflective as possible to infrared energy. Suitable materials are described in the aforesaid patents U.S. Pat. No. 4,160,929 and 4,409,512, but the exact type of coating material is not critical to the invention. The overall shape of the envelope and construction and location of the envelope and the coating 40 are selected so that as much IR energy as possible will be reflected back to the filament.

Figure 2:
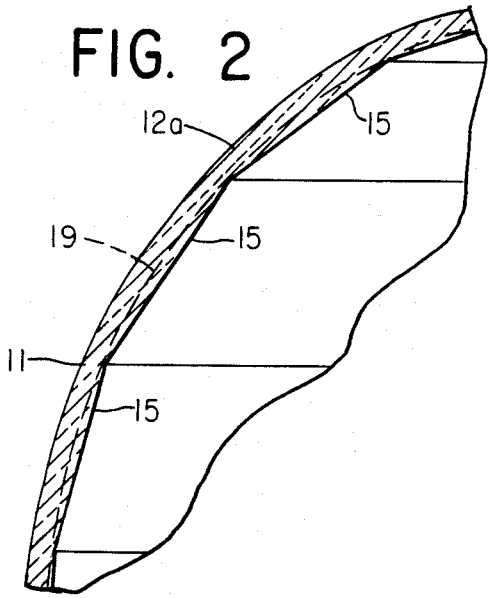
FIG. 2 is an enlarged fragmentary cross-section of a portion of the lamp of FIG. 1.

FIG. 2 shows the details of the inner surface of the envelope section 12*a*. As seen, the inner surface, rather than being smooth and having a continuous elliptical curve, as shown by the dotted line 13, is formed by a number of straight sections 15.

In the manufacture of incandescent lamps with IR reflective coatings it has been found that circular symmetry about the vertical axis of the lamp along which the filament lies, is much more important in the context of saving energy than the accuracy of the bulb shape from equator to north or south pole. Since the lamp envelope is generally ellipsoidal, as previously described, there is circular symmetry in planes transverse to the filament's longitudinal axis. That is, the shape of the envelope parallel to the equator of the envelope, which generally is at the joining seam 13 (FIGS. 1 and 3) of the two sections 12*a*, 12*b*, is circular.

In accordance with the invention, the curved inner wall of the envelope from each pole to the end of the curve is formed by a series of short connected straight sections, or chords, 15 as shown in FIG. 2. The chords 15 are shown related to a curved line 13 which corresponds to the original design shape of the envelope and defines the envelope intercept points for the ends of each chord. The lengths of the various chords 15 is not critical. However, as the chords are made smaller the inner wall surface more closely approximates a curved surface.

Because of the corners forming every pair of chords and the straight sections of the chords, the inner surface of the envelope can be more easily pressed with a more accurate circular latitudinal cross-section. That is, where the inner wall is to be continuous and smooth, it becomes difficult in high speed production due to various factors, such as sagging of the glass at high temperatures, to maintain accurate curvature and a smooth inner wall surface. Where the flat chord arrangement is used, accurate formation of the inner wall surface can be more precisely controlled. For example, the half sections 12*a* and 12*b* of the envelope can be pressed using a die formed of a number of steps of gradually decreasing diameter with overall ellipsoidal shape.

The reflection of the IR energy back to the filament is not seriously adversely affected by using the flat chord sections 15 instead of a continuous curved surface. IR energy from the filament which strikes the surface of a chord 15 will be reflected back to the filament at a point symmetric to its point of origin from the filament about the midpoint between $f_1$ and $f_2$. Its reflected distribution along the filament will be slightly more diffuse.

As described in U.S. Pat. No. 4,375,605, when an elliptical envelope of circular cross-section is used, there are two focal points which are produced. Depending upon the construction of the envelope, the infrared energy is redirected back to the filament along which these focal points lie. Since the optical aberation is a minimum at the two focal points, the sections of the filament at these focal points are being heated to a higher temperature than the other parts of the filament. In some instances, this is an undesired effect. By making the envelope's cross-section nearest the equator cylindrical rather than elliptical, this decreases the concentration of reflected radiation to the focal points on the filament.

In the preferred embodiment of the lamp shown in FIG. 1, the central section 17 of the envelope 11 is made cylindrical. Thus, the equatorial end of each of the envelope sections 12*a*, 12*b* is not formed with chords but is curved in only one direction to form the cylinder. In a typical embodiment, about ½ inch of the equatorial end of each envelope is made cylndrical. Since these parts are not curved in two directions, as are the remaining parts of the envelope, they are relatively easy to accurately manufacture. Also, the IR energy which is radiated out normal from the filament along its length is reflected back from the cylindrical section 17 along its length to maintain a more uniform temperature distributions. In a spherical envelope, the energy would be theoretically reflected back most efficiently at the central point and in an elliptical or ellipsoidal envelope at the two focii.

Figure 3:
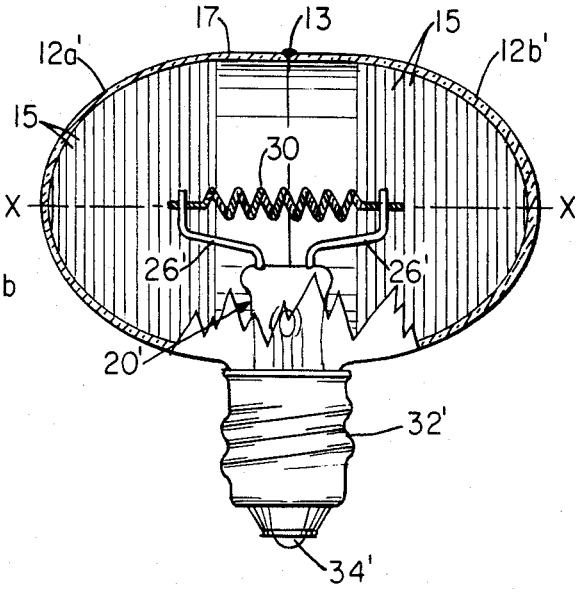
FIG. 3 is an overall view of another embodiment of invention.

FIG. 3 shows a further embodiment of the invention in which the lamp envelope has been rotated by 90° and the filament 30 is horizontal rather than vertical. Here, the two envelope half sections 12*a*′ and 12*b*′ are made so that they form an ellipsoid lying on its widest part rather than on its end as in FIG. 1. That is, the lamp base 31 is at the equator and not at the pole. The envelope is circular in the plane YZ and planes parallel thereto, with the filament 30 lying along the X axis. The flat chord segments 15 are shown greatly magnified, superimposed on the two sections of the envelope, with the central section of the envelope being cylindrical at 17 in the area opposite the filament. As seen, each chord segment 15 extends around the envelope parallel to the YZ plane and is of overall spherical shape but these chord segments stop at the cylindrical section 17.

In both of the embodiments of FIGS. 1 and 3, the chords and/or the filaments can be made in a direction transverse to that shown.

It also should be understood that the chord approach can be used with other envelopes of curved shape, e.g. parabolic or spherical. In the latter case, the sphere can be made of two hemispheres.

What is claimed is:

1. An incandescent electric lamp comprising:

an envelope, a wall of the envelope having an inner curved surface and a generally curved outer surface, an incandescent filament located within said envelope, means connecting said incandescent filament to a source of electrical power to cause it to incandesce, the curved inner surface of said envelope defined by a plurality of interconnected, substantially flat chord surfaces interposed to each other at an angle, and a coating of infrared reflecting visible light transmissive material coated on the inner surface of the envelope, whereby the inner curved surface of the envelope and orientation of said chord surfaces reflect infrared energy radiated by said filament back toward said filament.

2. An incandescent electric lamp as in claim 1 where said envelope is made of two sections which are joined together.

3. An incandescent electric lamp as in claim 1, wherein the shape of the envelope is elliptical from pole to pole and circular in planes taken parallel to the equator of the envelope.

4. An incandescent electric lamp as in claim 2 wherein said chords each define an area having a circular area of revolution.

5. An incandescent electric lamp as in claim 4 wherein said filament is elongated and lies transverse to an envelope equator.

6. An incandescent electric lamp as in claim 5 wherein said filament lies along a line between the poles of an ellipsoid of the envelope and the two focii of the ellipsoid.

7. An incandescent electric lamp as in claim 6 further comprising a base for housing said connecting means, said base being at one of said poles.

8. An incandescent electric lamp as in claim 6 further comprising a base for housing said connecting means, said base being at the equator of the envelope.

9. An incandescent electric lamp as in claim 1 wherein the envelope is generally spherical overall.

10. An incandescent electric lamp of claim 1 further comprising the envelope having a first elliptical section at one end thereof, a cylindrical section of the envelope being connected to the first elliptical section, a second elliptical section being located at the other end of the envelope.

11. An incandescent electric lamp comprising:

an envelope, a wall of the envelope having an inner curved surface and a generally curved outer surface, an incandescent filament located within said envelope, means connecting said incandescent filament to a source of electrical power to cause it to incandesce, the curved inner surface of said envelope defined by a plurality of chord surfaces, and a coating of infrared reflecting visible light transmissive material coated on the inner surface of the envelope, the envelope having a first elliptical section starting at one end thereof, a cylindrical section of the envelope being connected to the first elliptical section, a second elliptical section being located at the other end of the envelope, whereby the inner curved surface of the envelope and orientation of said chord surfaces reflect infrared energy radiated by said filament back toward said filament.

12. An incandescent electric lamp according to claim 11 wherein the cylindrical section of the envelope connects the first and second elliptical sections.

13. An incandescent electric lamp according to claim 10 wherein the cylindrical section of the envelope connects the first and second elliptical sections.

14. An incandescent electric lamp according to claim 1 wherein an accurate formation of said plurality of interconnected chord surfaces improves the precision of formation of the inner surface of the envelope.

15. An incandescent electric lamp according to claim 2 wherein each said section contains the curved inner surface of the envelope defined by a plurality of interconnected, substantially flat surfaces.

* * * * *